US007147224B2

(12) United States Patent
Chuang

(10) Patent No.: US 7,147,224 B2
(45) Date of Patent: Dec. 12, 2006

(54) MULTIFUNCTIONAL CYLINDRICAL SLIDING BLOCK JIGSAW PUZZLE

(76) Inventor: Shih-Hung Chuang, 14F-2, No. 343, Chungho Rd., Yungho City, Taipei Hsien (TW)

( * ) Notice: Subject to any disclaimer, the term of this patent is extended or adjusted under 35 U.S.C. 154(b) by 14 days.

(21) Appl. No.: 11/050,835

(22) Filed: Feb. 7, 2005

(65) Prior Publication Data

US 2006/0175752 A1 Aug. 10, 2006

(51) Int. Cl.
*A63F 9/08* (2006.01)

(52) U.S. Cl. ..... 273/153 S

(58) Field of Classification Search ..... 273/153 S, 273/157 R, 153 R

See application file for complete search history.

(56) References Cited

U.S. PATENT DOCUMENTS 1,555,980 A * 10/1925 Harrison ..... 273/153 S
4,522,401 A * 6/1985 Gustafson ..... 273/153 S
4,949,969 A * 8/1990 Johnson ..... 273/153 S
5,074,561 A * 12/1991 Johnson ..... 273/153 S
5,116,053 A * 5/1992 Blankenburg et al. ... 273/153 S
5,429,364 A * 7/1995 Chang ..... 273/153 S
5,845,904 A * 12/1998 Hawkins ..... 273/153 S
7,021,625 B1 * 4/2006 Simmons ..... 273/157 R

* cited by examiner

*Primary Examiner*—Steven Wong
(74) *Attorney, Agent, or Firm*—Bacon & Thomas PLLC

(57) ABSTRACT

A cylindrical sliding block jigsaw puzzle includes a barrel as a support; multiple arcuate sliding blocks combined together to construct a pattern on an outer periphery of the barrel; and an unslidable block detachably attached to an empty area defined in the outer periphery of the barrel. Beside being playable as a sliding block jigsaw puzzle, the cylindrical sliding block jigsaw puzzle also can be used as a pen container or a money box.

6 Claims, 12 Drawing Sheets

MULTIFUNCTIONAL CYLINDRICAL SLIDING BLOCK JIGSAW PUZZLE

BACKGROUND OF THE INVENTION

1. Field of the Invention

The present invention relates to a jigsaw puzzle, and more particular to a multifunctional cylindrical sliding block puzzle.

2. Description of Related Art

Nowadays, jigsaw puzzles are very popular games, but most of them are only two-dimensional. With reference to FIG. 11, a conventional sliding block jigsaw puzzle has a planar configuration and is composed of a plurality of sliding blocks. Patterns or pictures can be printed on a board made of paper or other material, and the board is cut into a plurality of bits. A player must reunite the pattern by fitting together these bits. However, the conventional sliding block jigsaw puzzle only has a 2D (two-dimensional) pattern with a limited decorative effect.

Therefore, the invention provides a cylindrical sliding block jigsaw puzzle game to mitigate the aforementioned problems.

SUMMARY OF THE INVENTION

The main objective of the present invention is to provide a multifunctional cylindrical sliding block jigsaw puzzle game which can be played as a common sliding block jigsaw puzzle, or used as a container such as a pencil container or money box.

To achieve the above objective, the present invention includes:

a barrel;

multiple arcuate sliding blocks with substantial equal size and combined together to construct a pattern on an outer periphery of the barrel in a coordinated status and defining an empty area with a size substantially equal to the size of the arcuate sliding blocks; and an unslidable block received in the empty area defined by these sliding blocks and detachably mounted on the outer periphery of the barrel.

According to another aspect of the invention, the barrel has a hole defined in the empty area, and the unslidable block has a lug formed at an inner side and inserted in the hole of the barrel to position the immovable block.

According to a further aspect of the invention, the barrel has a tubular part, and a seat detachably mounted at a bottom of the tubular part.

According to another further aspect of the invention, the barrel has a bar longitudinally formed at an outer periphery of the tubular part.

According to another aspect of the invention, the barrel has a cover detachably mounted at a top of the tubular part, and a slot is defined through the cover.

According to yet another aspect of the invention, the arcuate sliding blocks each have an outer portion with multiple pins formed at an inner side of the outer portion, and an inner portion being composed of two segments with the equal size integrally formed together in a nonaligned arrangement, multiple apertures defined through the first segment to respectively receive the pins for positioning the outer portion on the inner portion to align the outer portion with the second segment of the inner portion, whereby, a groove is defined at two adjacent sides of the sliding block between the outer portion and inner portion, and a tongue is protruded from the other two adjacent sides of the sliding block between the outer portion and inner portion.

According to a further aspect of the invention, the barrel has a rim formed at a top of the tubular part, and a ring rib is formed at a bottom of the rim and received in the grooves of the sliding blocks in the top row.

According to another further aspect of the invention, the seat has a ring groove defined in the seat for receiving the tongues of the sliding blocks in the bottom row.

According to another aspect of the invention, the outer portion of the arcuate block has four pins, and the inner portion of the arcuate block has four apertures respectively receiving the four pins.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
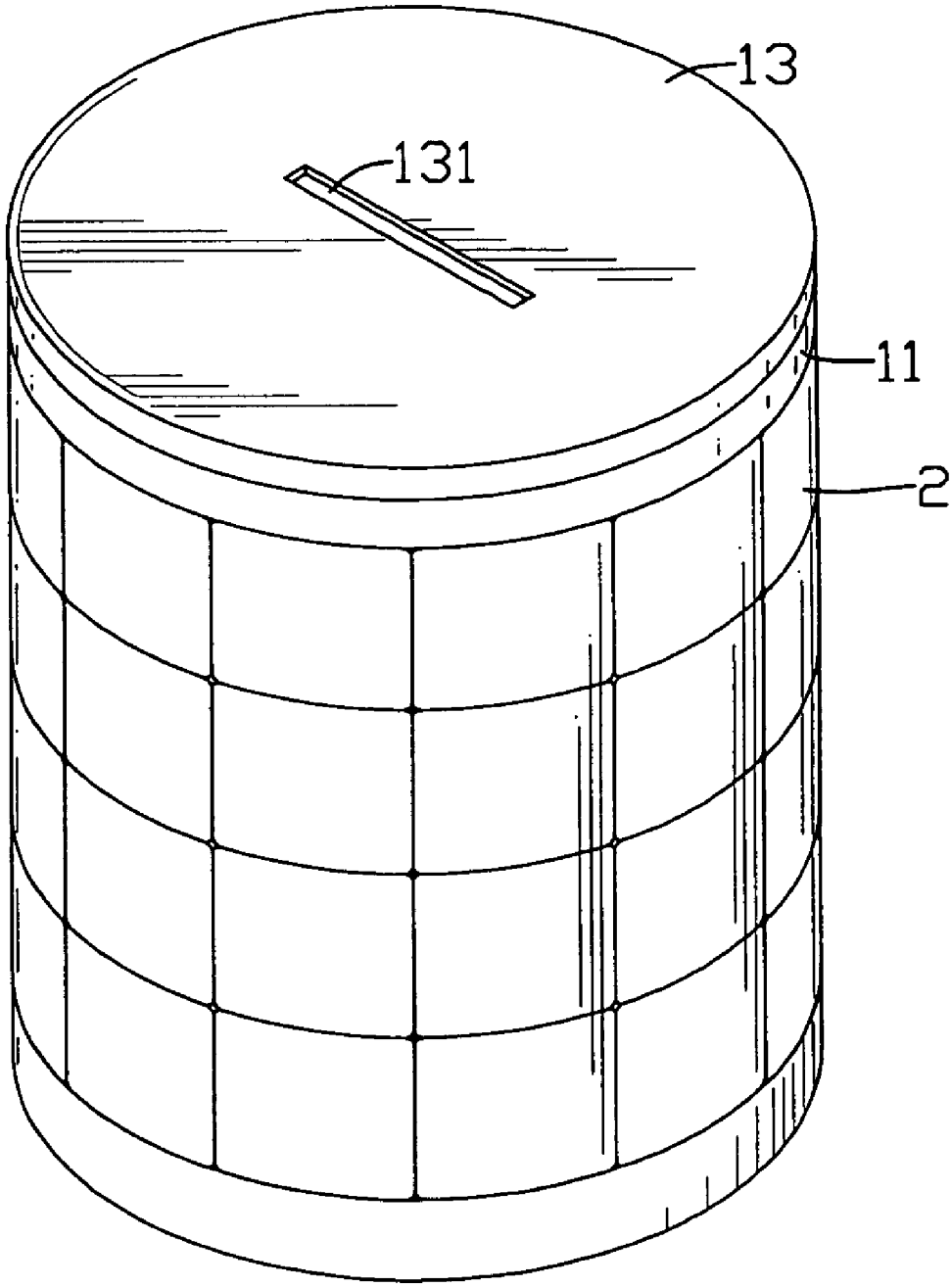
FIG. 1 is a perspective view of a cylindrical sliding block jigsaw puzzle in accordance with the present invention.

With reference to FIGS. 1, 2A, 3, 4, 5 and 6, a cylindrical sliding block jigsaw puzzle in accordance with the present invention has a cylindrical barrel (1) as a support of the puzzle, and multiple substantially arcuate sliding blocks (2) slidably provided edge to edge at an outer periphery of the cylindrical barrel (1).

The cylindrical barrel (1) includes a tubular part (11), a seat (12) detachably mounted at a bottom of the tubular part (11), and a cover (13) detachably mounted at a top of the tubular part (11). The cover (13) has a slot (131) defined therethrough to communicate with an interior of the tubular part (11) of the cylindrical barrel (1).

With reference to FIGS. 2A, 3–6, each of the arcuate sliding blocks (2) is composed of an outer portion (21) and an inner portion (22) assembled together. The inner portion (22) is composed of two segments with an equal size integrally formed together in a nonaligned arrangement. Multiple apertures (221) (four in this embodiment) are defined through a first of the two segments of the inner portion (22). Multiple pins (211) (four in this embodiment) are formed on the outer portion (21) and respectively inserted in the apertures (221) to align the outer portion (21) with the second segment of the inner portion (22). Thus, a groove (23) is defined at two adjacent sides of the sliding block (2) between the outer portion (21) and inner portion (22), and a tongue (24) is protruded from the other two adjacent sides of the sliding block (2) between the outer portion (21) and inner portion (22). Therefore, in assembly, with reference to FIG. 4A, the tongue (24) of this sliding block (2) is received in the grooves (23) of the two adjacent sliding blocks (2); and the groove (23) of this sliding block (2) receives the tongues (24) of two other adjacent sliding blocks (2).

Figure 3:
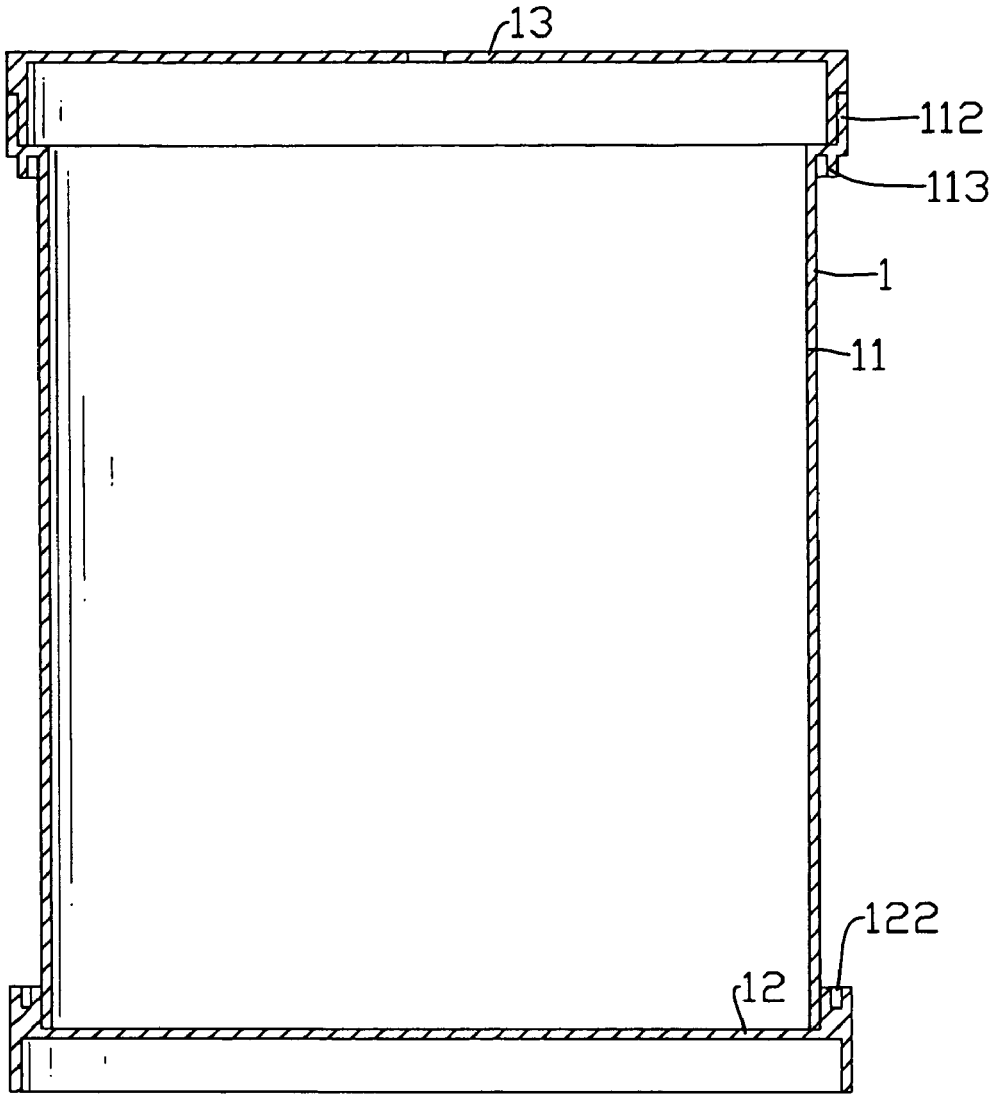
FIG. 3 is a cross sectional view of the first embodiment shown in FIG. 1.
Figure 4:
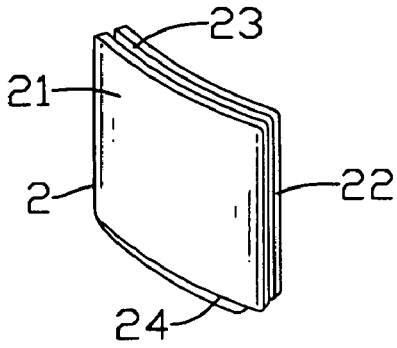
FIG. 4 is a front perspective view of a sliding block of the cylindrical sliding block jigsaw puzzle.
Figure 5:
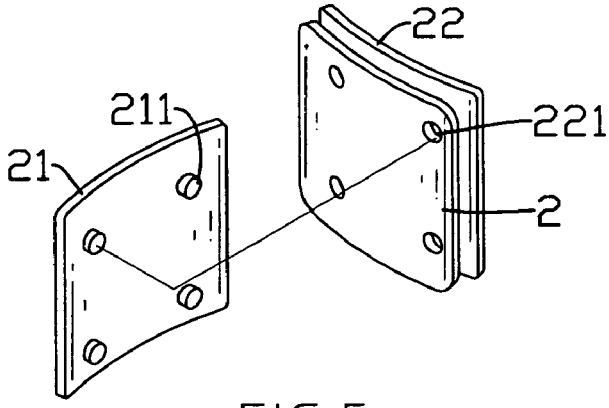
FIG. 5 is an exploded perspective view of FIG. 4.
Figure 6:
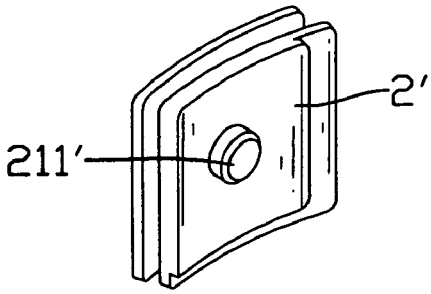
FIG. 6 is a rear perspective view of an unslidable block of the cylindrical sliding block jigsaw puzzle.
Figure 4A:
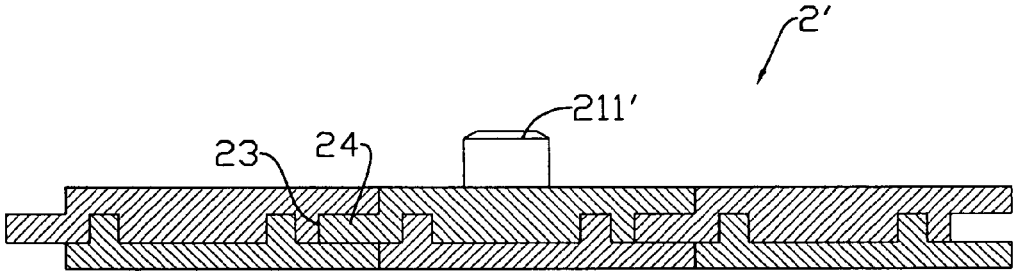
FIG. 4A is a schematic cross sectional view showing engagement among sliding blocks via the tongues and the grooves.

As illustrated in FIG. 3, the tubular part (11) has a rim (112) formed at an upper end thereof, and a ring rib (113) is formed at a bottom of the rim (112) and received in the grooves (23) of the sliding blocks (2) in the top row. A ring groove (122) is defined in the seat (12) for receiving the tongues (24) of the sliding blocks (2) in the bottom row.

Figure 2A:
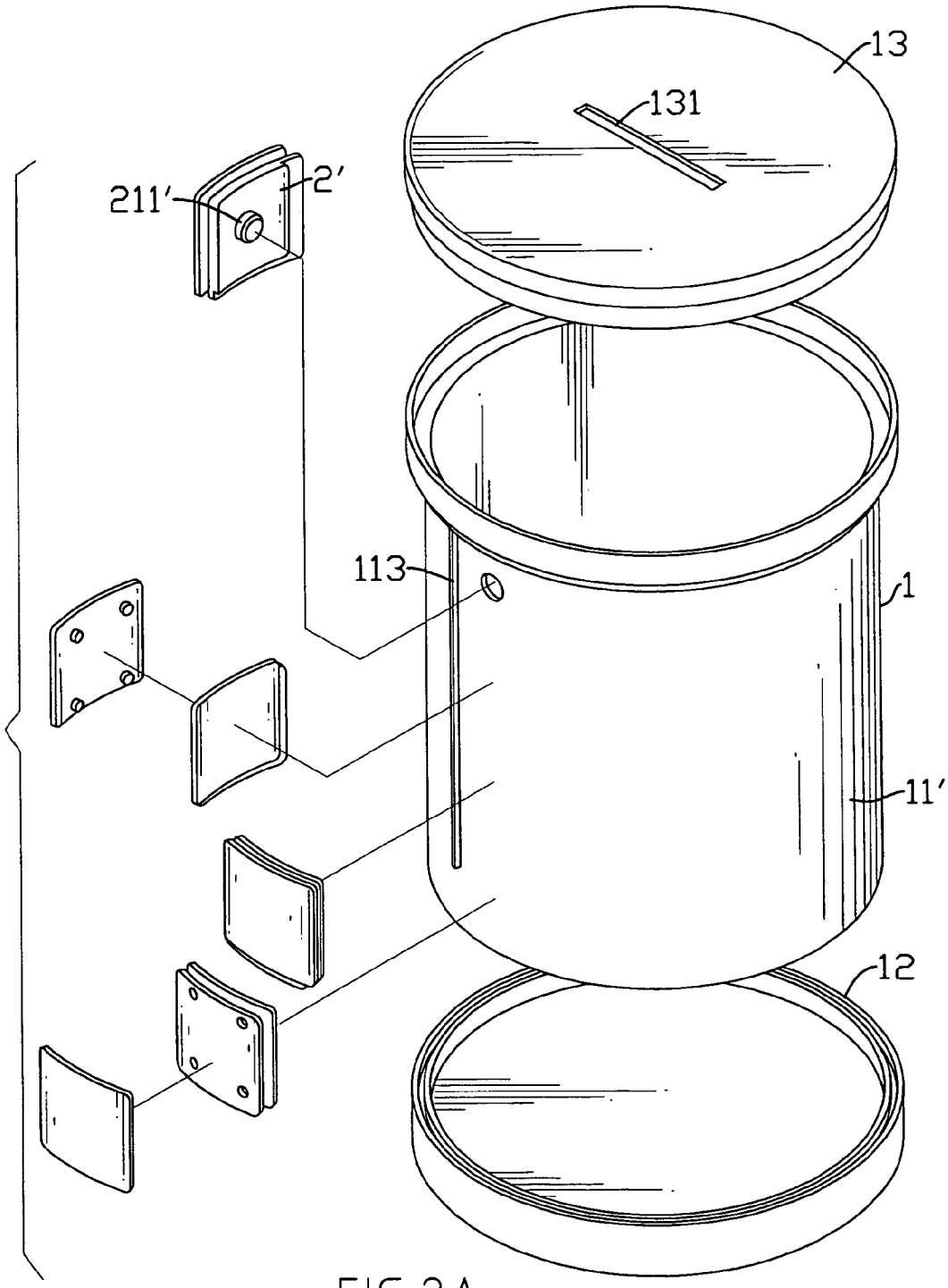
FIG. 2A is an exploded perspective view of a first embodiment of the cylindrical sliding block jigsaw puzzle.
Figure 7:
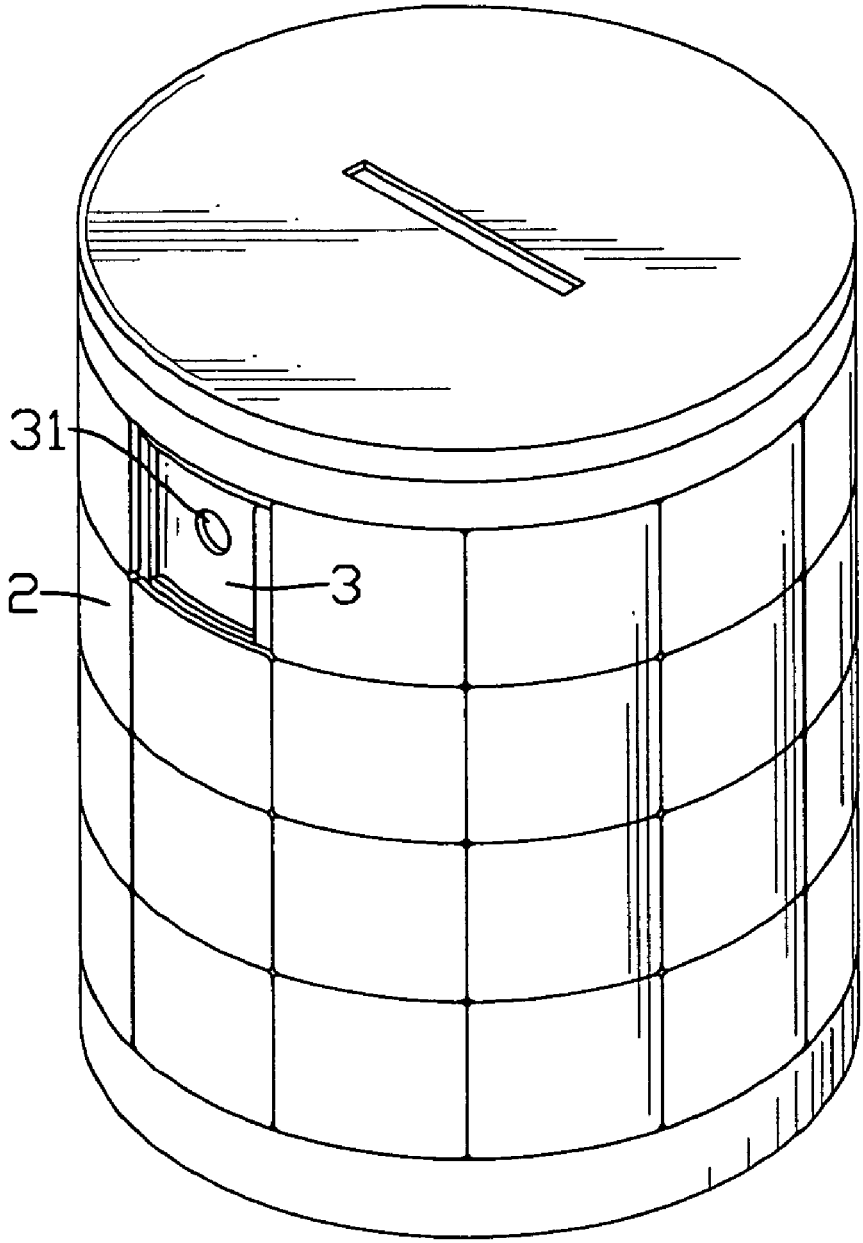
FIG. 7 is a perspective view of the cylindrical sliding block jigsaw puzzle where the unslidable block is removed to show the empty area defined in the outer periphery of the barrel.
Figure 8:
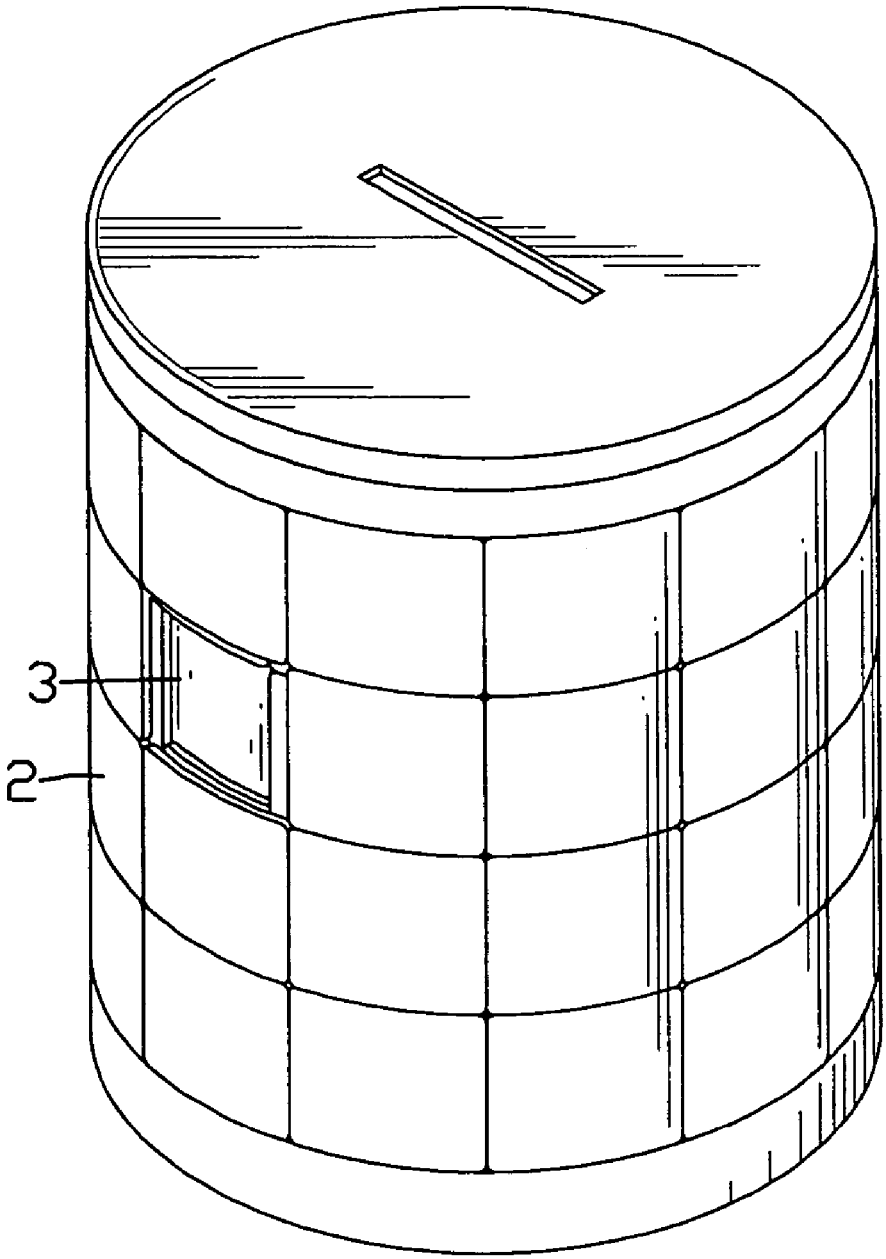
FIGS. 8–10 are schematic views showing the operation of the sliding block jigsaw puzzle of the present invention.
Figure 9:
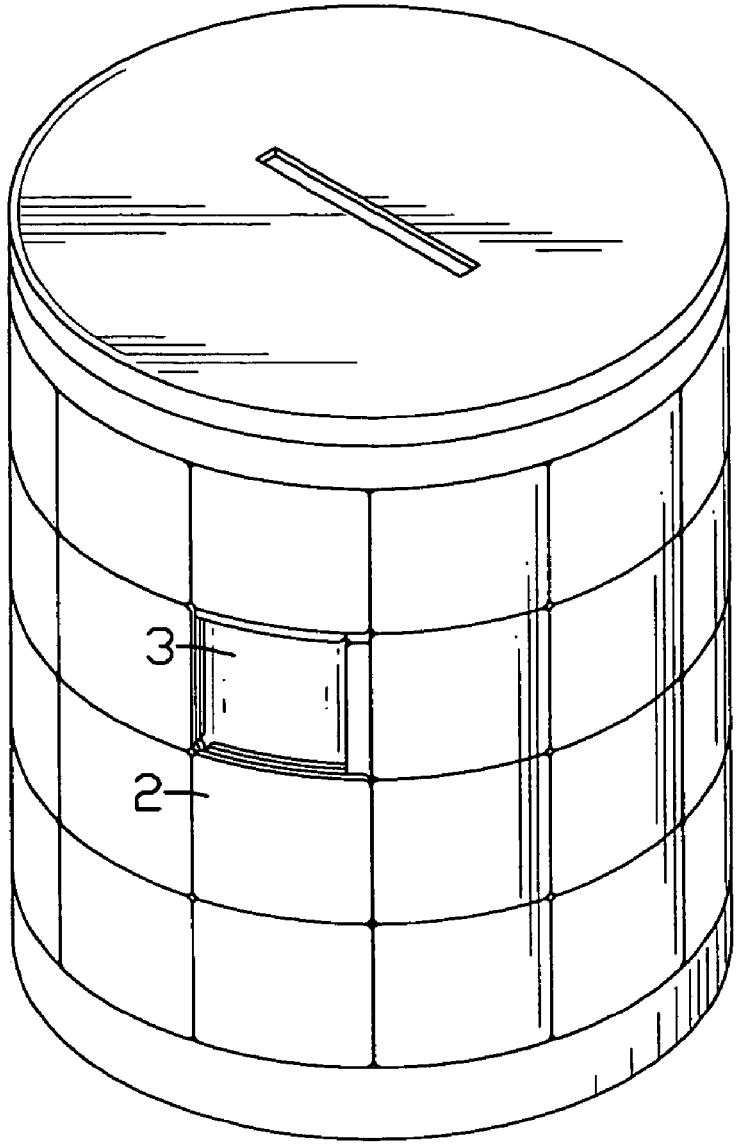
Figure 10:
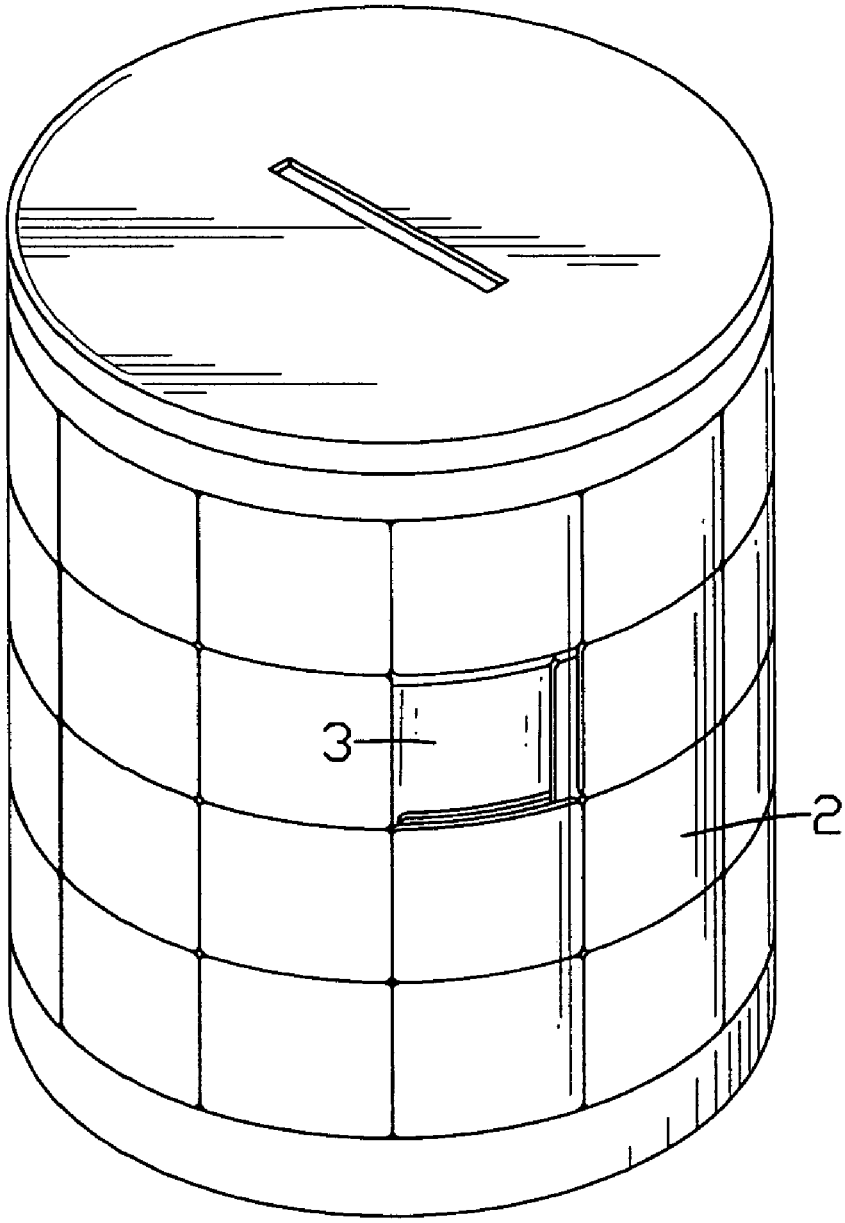
Figure 11:
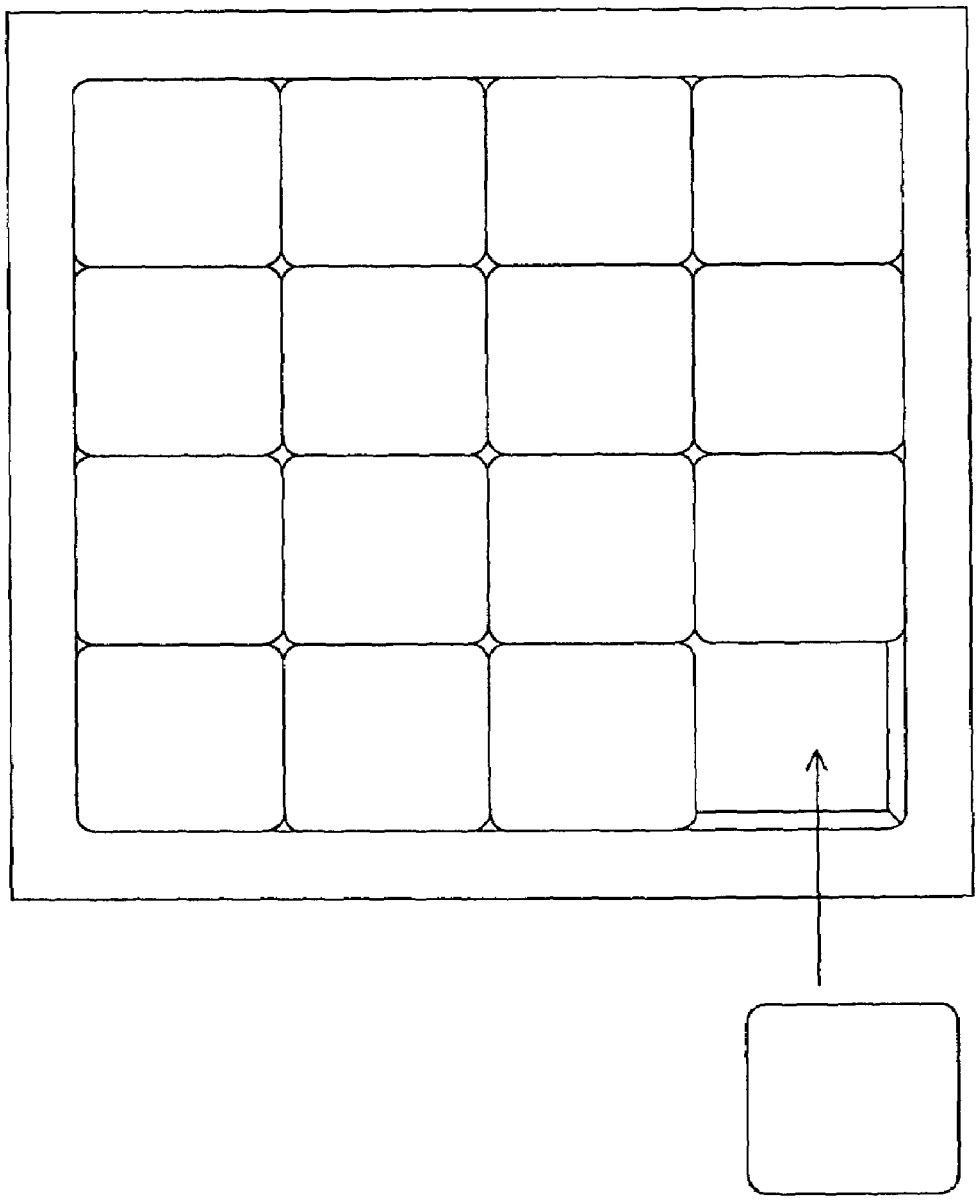
FIG. 11 PRIOR ART
FIG. 11 is a schematic view of a conventional two-dimensional sliding block jigsaw puzzle.

Furthermore, with reference to FIGS. 2A and 7, an empty area (3) substantially equal to the size of one sliding block (2) is defined in these sliding blocks (2). The outer periphery of the tubular part (11) can be seen from the empty area (3), and a hole (31) is defined in the empty area (3). An unslidable block (2') has a lug (211') formed at an inner side thereof and can be positioned in the empty area (3) by inserting the lug (211') into the hole (31).

With reference to FIGS. 7–10, when the unslidable block (2') is removed from the barrel (1), the sliding blocks (2) can be longitudinally or transversally moved by changing the position of the empty area (3), so a user can reunite the pattern in an uncoordinated arrangement and vice versa.

In the first embodiment as shown in FIG. 2A, a bar (113) is longitudinally formed on an outer periphery of the tubular part (11) to disable the sliding blocks (2) beside the bar (113) to transversally slide over the bar (113). Thus, the transversal sliding movement of the blocks (2) is limited by the bar (113) to increase the playing difficulty level.

Figure 2B:
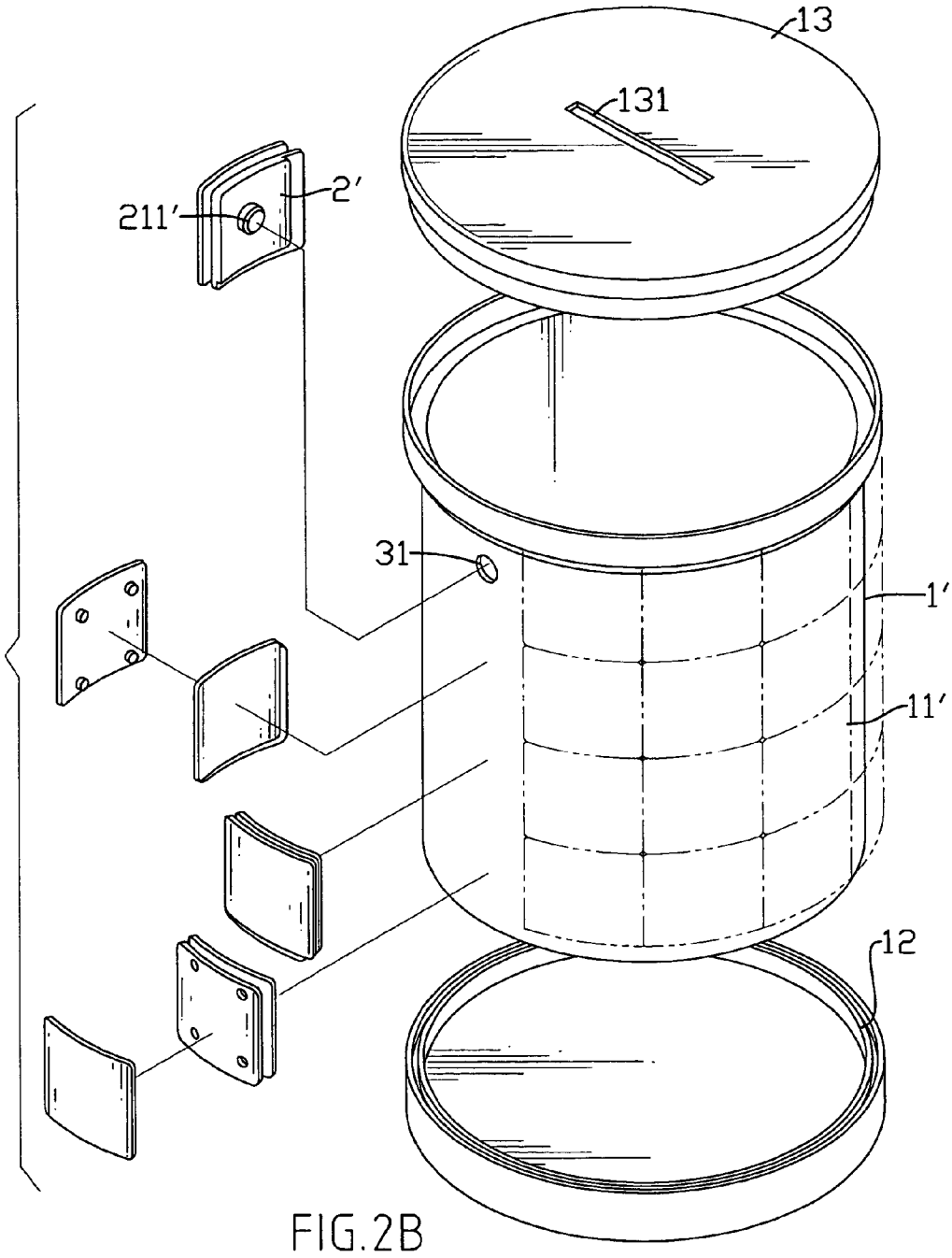
FIG. 2B is an exploded perspective view of a second embodiment of the cylindrical sliding block jigsaw puzzle.

Alternatively, in a second embodiment as shown in FIG. 2B, the barrel (1') has the tubular part (11') without the bar. Thus, the difficulty level of playing this puzzle is low compared to the embodiment in FIG. 2A.

Moreover, when the cover (13) is removed from the barrel (1), the puzzle can be used as a pen container. When the cover (13) is mounted on the barrel (1), the puzzle can be used as a money box.

Figure 2C:
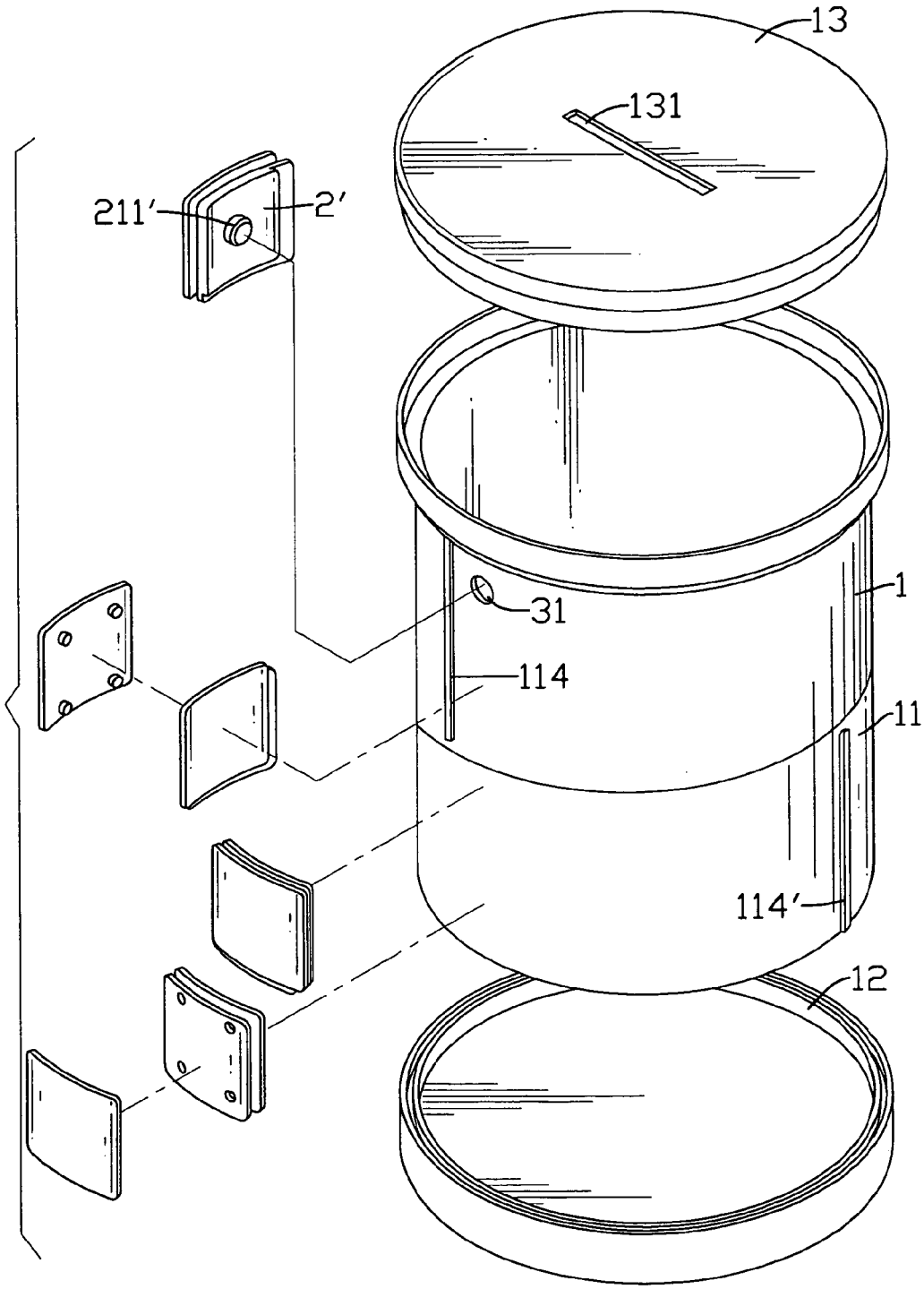
FIG. 2C is an exploded perspective view of a third embodiment of the cylindrical sliding block jigsaw puzzle.

Furthermore, from the depiction of FIG. 2C, it is noted that a first bar (114) and a second bar (114') are longitudinally yet randomly formed on the outer periphery of the cylindrical barrel (1) to limit the movement of the sliding blocks (2) so as to increase the difficulty level of the jigsaw puzzle game.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cylindrical sliding block jigsaw puzzle comprising:

a cylindrical barrel;.

multiple arcuate sliding blocks with substantially equal size and interconnected with one another to construct a pattern on an outer periphery of the cylindrical barrel in a coordinated status and defining an empty area with a size substantially equal to the size of one of the arcuate sliding blocks; and an unslidable block received in the empty area defined by the arcuate sliding blocks and detachably mounted on the outer periphery of the barrel, wherein each arcuate sliding block is movable relative to the cylindrical barrel so that a position of the empty area is changed so as to enable the pattern to be reconstructed, wherein the cylindrical barrel has a hole defined in a face partly defining the empty area, and the unslidable block has a lug formed at an inner side of the unslidable block to extend into the hole of the barrel to position the unslidable block, wherein the barrel has a bar longitudinally formed at an outer periphery of the barrel to partially limit the movement of the arcuate sliding blocks so as to increase difficulty level of reconstructing the pattern, and wherein the arcuate sliding blocks each have an outer portion with multiple pins formed at an inner side of the outer portion, and an inner portion is composed of two segments with the equal size integrally formed together in a nonaligned arrangement, multiple apertures are defined through a first segment to respectively receive the pins for positioning the outer portion on the inner portion to align the outer portion with a second segment of the inner portion, whereby, a groove is defined at two adjacent sides of the arcuate sliding block between the outer portion and inner portion, and a tongue is protruded opposite to the groove and between the outer portion and inner portion.

2. The sliding block jigsaw puzzle as claimed in claim 1, wherein the barrel is a tubular part, and a seat is detachably mounted at a bottom of the tubular part.

3. The sliding block jigsaw puzzle as claimed in claim 2, wherein the barrel has a cover detachably mounted at a top of the tubular part, and a slot is defined through the cover.

4. The sliding block jigsaw puzzle as claimed in claim 2, wherein the barrel has a rim formed at a top of the tubular part, and a ring rib is formed at a bottom of the rim and received in the grooves of the sliding blocks in the top row.

5. The sliding block jigsaw puzzle as claimed in claim 4, wherein the seat has a ring groove defined in the seat for receiving the tongues of the sliding blocks in the bottom row.

6. The sliding block jigsaw puzzle as claimed in claim 5, wherein the outer portion of the arcuate sliding block has four pins, and the inner portion of the arcuate sliding block has four apertures respectively receiving the four pins.

* * * * *